US007960907B2

(12) United States Patent
Takahashi et al.

(10) Patent No.: US 7,960,907 B2
(45) Date of Patent: Jun. 14, 2011

(54) LIGHT-EMITTING APPARATUS

(75) Inventors: Hisaya Takahashi, Kanagawa (JP); Toshiya Arakawa, Tokyo (JP); Atsushi Namba, Tokyo (JP); Mikio Ono, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 274 days.

(21) Appl. No.: 12/266,488

(22) Filed: Nov. 6, 2008

(65) Prior Publication Data

US 2009/0121601 A1 May 14, 2009

(30) Foreign Application Priority Data

Nov. 9, 2007 (JP) ..... 2007-292204

(51) Int. Cl.
*H01J 1/304* (2006.01)
*H01J 1/30* (2006.01)

(52) U.S. Cl. ..... 313/496; 313/495; 313/497

(58) Field of Classification Search ..... 313/495–497, 313/309, 311
See application file for complete search history.

(56) References Cited

U.S. PATENT DOCUMENTS

| | | | | |
|---|---|---|---|---|
| 5,581,149 | A * | 12/1996 | Seko et al. | 313/493 |
| 2007/0262698 | A1 * | 11/2007 | Popovich | 313/497 |
| 2007/0262699 | A1 * | 11/2007 | Takahashi et al. | 313/497 |

FOREIGN PATENT DOCUMENTS

| | | |
|---|---|---|
| JP | 10-012164 | 1/1998 |
| JP | 2000-251797 | 9/2000 |
| JP | 2004-207066 | 7/2004 |

* cited by examiner

*Primary Examiner* — Bumsuk Won
*Assistant Examiner* — Nathaniel J Lee
(74) *Attorney, Agent, or Firm* — Haynes and Boone, LLP

(57) ABSTRACT

Provided herein is a light-emitting apparatus which is capable of causing the light emitted at the entire face of a fluorescent material to be exteriorly emitted with no interference and with enhanced light emission efficiency, thereby attaining an exteriorly radiated high brightness light. A cathode electrode 10 is mounted on a periphery of a transmission member 30, the anode electrode 15 is also mounted on a domain opposite to a light transmission member 30, and the surface 16*a* of the fluorescent material 16 to be mounted on a top layer of the anode electrode 15 is formed with a concave face. In accordance therewith, even when the cathode electrode 10 is offset mounted on a periphery of the light transmission member 30 it can be caused to precisely face the surface 16*a* of the fluorescent material 16 and the excitation light from the entire face of the surface 16*a* of the fluorescent material 16 can made incident onto the light transmission member 30 without interference from the cathode electrode 10 or the like.

3 Claims, 4 Drawing Sheets

LIGHT-EMITTING APPARATUS

CROSS REFERENCE TO RELATED APPLICATIONS

This application claims priority under 35 U.S.C. 119 based upon Japanese Patent Application Serial No. 2007-292204, filed on Nov. 9, 2007. The entire disclosure of the aforesaid application is incorporated herein by reference.

FIELD OF THE INVENTION

The present invention relates to a light-emitting apparatus which causes a fluorescent material to emit light upon excitation by the field-emitted electrons from an electron emission source.

BACKGROUND OF THE INVENTION

In contrast to the conventional light-emitting apparatuses such as incandescent lamps or fluorescent lamps, electron-beam excitation type light-emitting apparatuses have recently been developed which call for the electrons emitted in a vacuum chamber from an electron emission source to be thrown at high speed upon a fluorescent material thereby causing the fluorescent material to emit light upon excitation therewith for use in illumination or image display.

This type of light-emitting apparatus, as for example disclosed in Japanese Unexamined Patent Application Publication No. 2004-207066 (Patent reference 1), is generally structured to pass the emitted light from the surface of the fluorescent material through a glass substrate at the back side of the fluorescent material and to radiate it exteriorly; however, with this structure, even though the side of the fluorescent material irradiated with the electron beam generates the most intense light emission, that emitted light ends up dissipating as a useless light emission in the vacuum chamber, so that it cannot necessarily be said that the light emission efficiency of the apparatus is good.

For this reason, a technology is known for electron beam excitation type display devices, which calls for forming a metal back layer by vapor deposition of aluminum or the like on the side of the fluorescent material which is irradiated with the electron beam, thereby enhancing the brightness. Metal backs are designed, in addition to specularly reflecting the light to the device interior side from the fluorescent material to a device exterior side (a display face side or illumination face side), thereby enhancing the brightness, to protect the fluorescent material from damage by electrons charged on the fluorescent face, damage by impingement of negative ions generated within the device, and the like, which is, for example, disclosed in Japanese Unexamined Patent Application Publication No. 2000-251797 (Patent reference 2).

The technology of Patent reference 2 comprises, in an image generation device for displaying an image by causing a fluorescent film to exhibit light, dividing a metal back provided in the interior face side of the fluorescent film into multiple portions and covering the multiple gaps dividing these portions with a conductive material, thereby preventing a creeping surface discharge from the surfaces of the gap portions due to an abnormal electrical discharge generated in a vacuum and attaining the stabilization of display quality.

However, the technology of improving the device's light emission efficiency using a metal back is such that upon the electron beam penetrating the metal back layer, the acceleration energy thereof is lost, thereby lowering the fluorescent material's excitation efficiency. In particular, for applications in illumination devices, a decrease in fluorescent material's excitation efficiency resulting from the loss of its acceleration energy can neither be ignored nor is conducive to a fundamental improvement in light emission efficiency.

To address this problem, Japanese Unexamined Patent Application Publication No. H10-12164 (Patent reference 3) discloses a technology on a thin display device, comprising a cathode plate which is provided with an emitter electrode line equipped with emitter tips in domains constituting pixels and a gate electrode line mounted so as to intersect the emitter electrode line in the domains constituting pixels, and an anode electrode plate having a fluorescent material layer, which are mounted oppositely with a predetermined separation, wherein at least the domains of the emitter electrode line and gate electrode line that constitute pixels are composed of transparent electrode films, whereby one can observe the emitted light of the fluorescent material layer through the two transparent electrode films, that is, to watch the emitted light of the fluorescent material from the fluorescent material's surface side.

The display technology of Patent reference 3, when used as a display device, can provide a high brightness display by viewing the emitted light from the fluorescent material's surface side; but when contemplated for an illumination application, this would mean acquiring illumination light through the cathode plate opposing the fluorescent material layer. In other words, this would end up using, as illumination light, the light released exteriorly through the gaps between the emitter tips and the lower layer metal conductive films of the emitter electrode line and gate electrode line; accordingly the light radiated from the fluorescent material would decay or scatter, preventing an effective use of the emitted light from the entire face of the fluorescent material.

The present invention has been made in view of the above-mentioned situation, and its objective is to provide a light-emitting apparatus which is capable of causing the light emitted at the entire face of a fluorescent material to be emitted exteriorly with no interference and with enhanced light emission efficiency, thereby attaining an exteriorly radiated high brightness light.

SUMMARY OF THE INVENTION

The present invention is a light-emitting apparatus comprising, within a vacuum chamber, a cathode electrode having an electron emission source and an anode electrode having a fluorescent material which emits light upon excitation by the field-emitted electrons from the electron emission source, the apparatus exteriorly radiating the light emitted by the fluorescent material upon excitation from a light transmission member mounted in the vacuum chamber, wherein the cathode electrode is mounted on a periphery of the light transmission member, and also the anode electrode is mounted in a domain opposite to the light transmission member, and wherein the surface of the fluorescent material on a top layer of the anode electrode is formed with a concave face which is opposite to the electron emission source and directs excitation light to the light transmission member.

The light-emitting apparatus of the present invention is capable of causing the light emitted at the entire face of the fluorescent material to be exteriorly emitted with no interference and enhancing the light emission efficiency, thereby attaining an exteriorly radiated high brightness light.

DETAILED DESCRIPTION OF THE INVENTION

Figure 1:
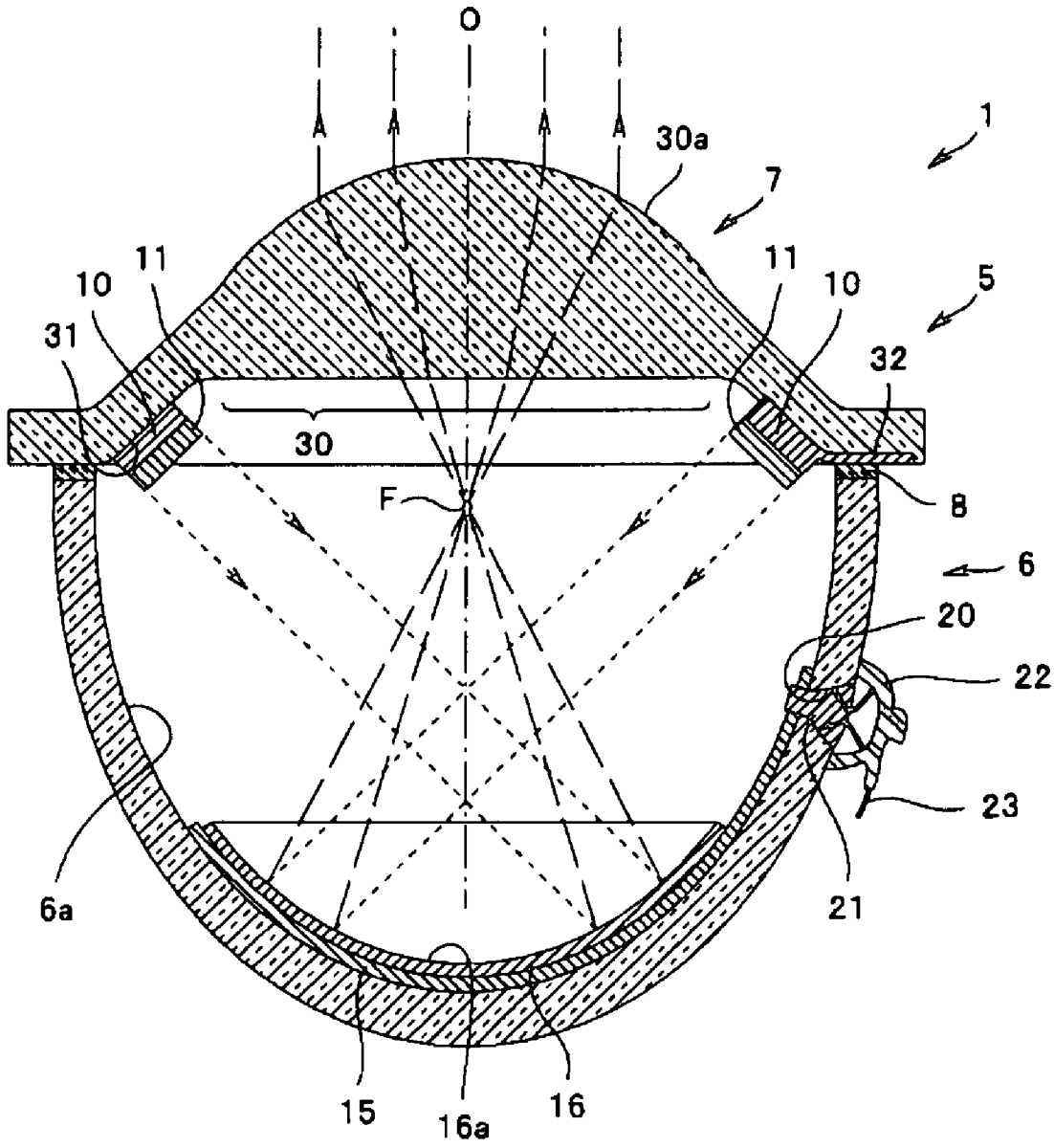
FIG. 1 is a cross sectional view of the principal parts of a light-emitting apparatus according one embodiment of the present invention.
Figure 2:
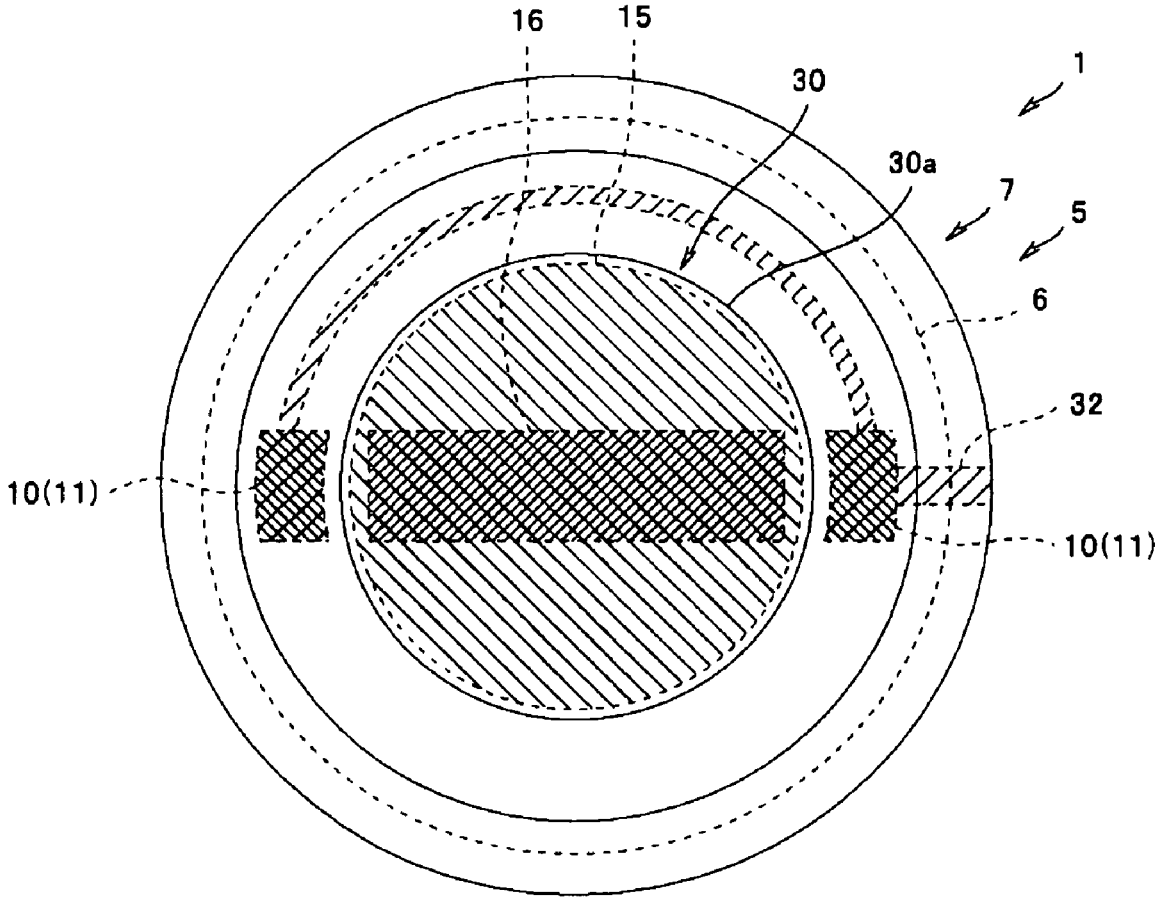
FIG. 2 is a plan view of a light-emitting apparatus as viewed from the light transmission member side according one embodiment of the present invention.
Figure 3:
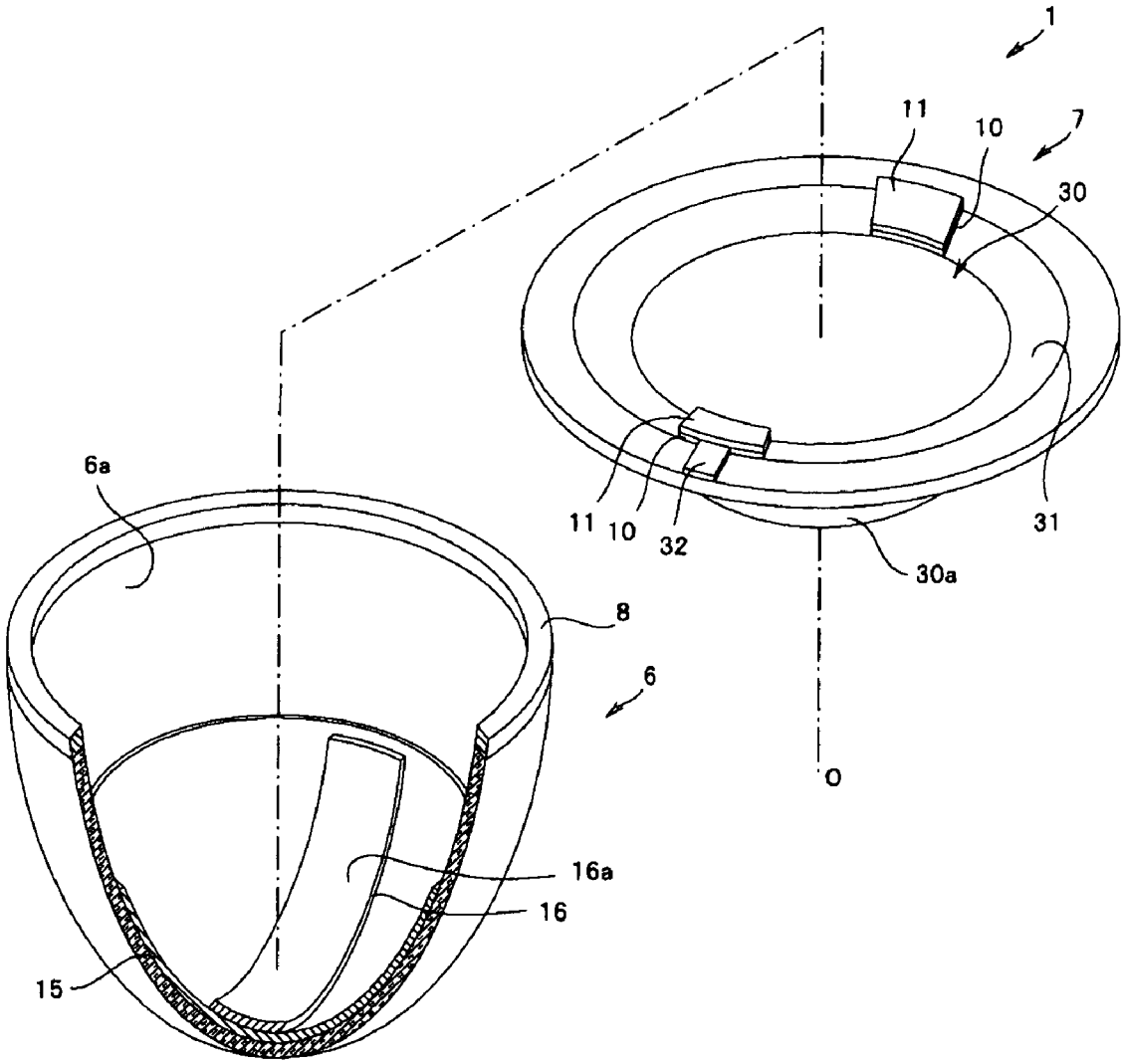
FIG. 3 is an exploded perspective view illustrating the principal parts of a light-emitting apparatus according one embodiment of the present invention.
Figure 4:
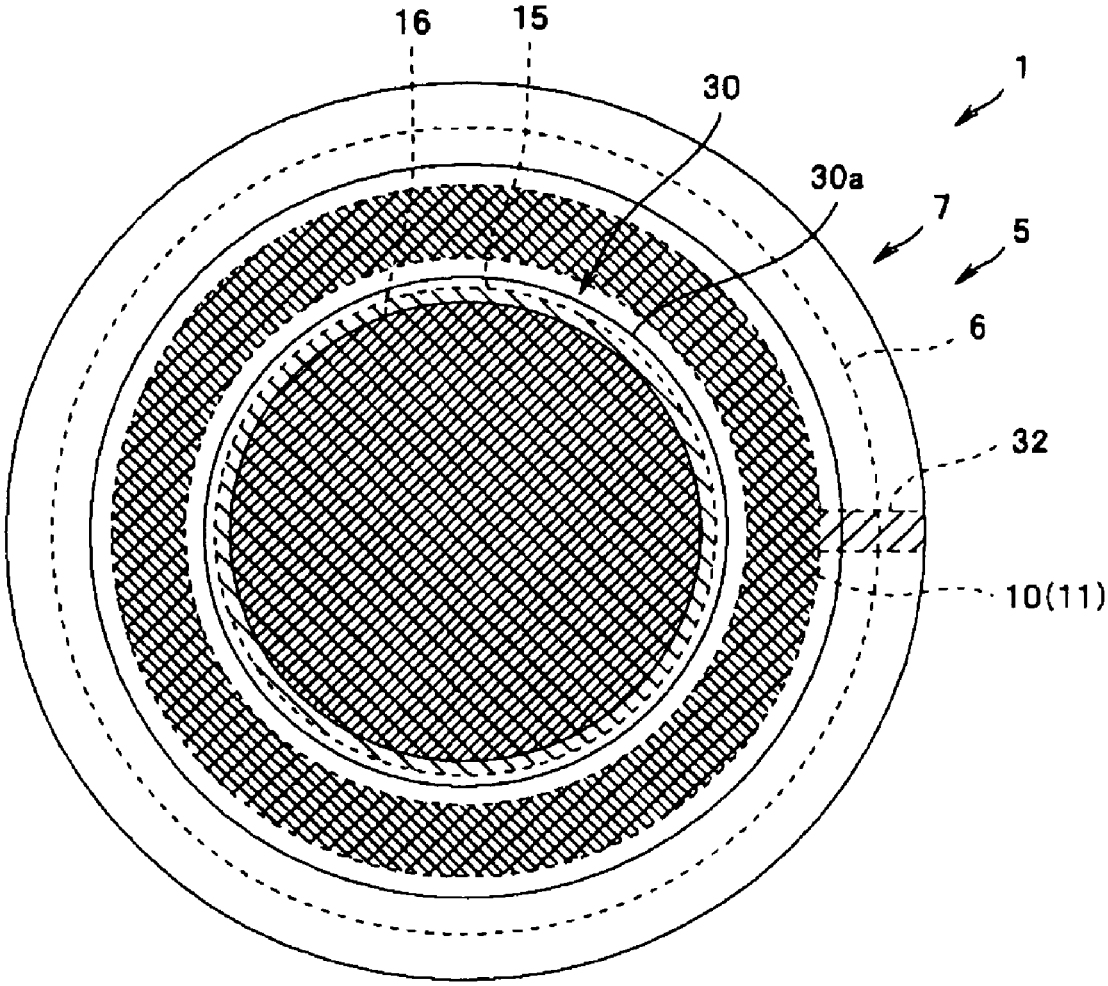
FIG. 4 is a plan view of a light-emitting apparatus variant example as viewed from the light transmission member side according one embodiment of the present invention.

Hereafter, embodiments of the present invention are described with reference to drawings. The drawings relate to an embodiment of the present invention, where FIG. 1 is a cross sectional view of the principal parts of a light-emitting apparatus; FIG. 2 is a plan view of a light-emitting apparatus as viewed from the light transmission member side; FIG. 3 is an exploded perspective view illustrating the principal parts of a light-emitting apparatus; and FIG. 4 is a plan view of a light-emitting apparatus variant example as viewed from the light transmission member side.

In FIG. 1, Reference number 1 is a light-emitting apparatus, and for example, is used as a light source for a flashlight or a searchlight. The light-emitting apparatus 1 is constituted for principal parts thereof of a cathode electrode 10 having an electron emission source 11 and an anode electrode 15 having a fluorescent material 16 which emits light upon excitation by the electrons field-emitted from the electron emission source 11, which electrodes are housed in a vacuum chamber 5.

The vacuum chamber 5 is, for example, composed of a jointly assembled body of multiple glass members. The vacuum chamber 5 has a chamber body 6 which is open at one end thereof and a lid body 7 which vacuum-seals the opening of the chamber body 6.

As shown in FIGS. 1 and 3, the chamber body 6 is composed of a paraboloid of revolution-shaped glass molded article of quartz glass or the like; the anode electrode 15 is mounted on the base side of an interior face 6*a* of the chamber body 6. In the present embodiment, the anode electrode 15 is composed of an electrically conductive pattern which is film-formed on the interior face 6*a* of the chamber body 6. This electrically conductive pattern is, for example, film-formed by depositing ITO, aluminum, nickel, and the like with a vapor deposition, sputtering method, or the like, or by applying a silver paste material followed by drying and firing, and the like.

As illustrated here in FIG. 1, a part of the chamber body 6 has through-holes 20 opened; the through-holes 20 are filled with an electrically conductive member 21 with a coefficient of thermal expansion close to that of the chamber body 6. In the interior of the chamber body 6, the electrically conductive member 21 is electrically connected to the anode electrode 15 whereby the anode electrode 15 is conductively connected to the exterior of the chamber body 6. Outside of the chamber body 6, on the other hand, the electrically conductive member 21 is covered with an anode cap 22 made of silicone rubber or the like; from the anode cap 22, an electrically conductive line 23 extends which is electrically connected to the electrically conductive member 21. Note that if the chamber body 6 is composed of quartz glass or the like, Kovar, an alloy blend of iron, nickel, and cobalt, can be appropriately used as an electrically conductive member 21.

On a top layer of the anode electrode 15 is film-formed the fluorescent material 16, for example, in a belt-like domain with an approximate rectangular shape in plane view (See FIG. 2). The fluorescent material 16 is film-formed, for example, by a screen-printing method, inkjet method, photography method, precipitation method, electrodeposition method, and the like. The surface (light emitting face) 16*a* of the fluorescent material 16, by having it film-formed on the top layer of the anode electrode 15, which has been film-formed along the interior face 6*a* of the chamber body 6 formed of a paraboloid of revolution face, is composed of a concave curved face with a basic shape of a paraboloid of revolution face. That is, in the present embodiment, the surface 16*a* of the fluorescent material 16 takes a partial form of a paraboloid of revolution face. With this construction, the light emitted upon excitation at the surface 16*a* of the fluorescent material 16 is condensed at the focal point F of the paraboloid of revolution face and is then diffused.

Moreover, there is formed at an opening edge of the chamber body 6 a low melting-point glass layer 8 which melts at 450° C. to 500° C. The chamber body 6 is vacuum sealed, for example, by having the chamber body 6 and the lid body 7 fused together via the low melting point glass layer 8 in a vacuum furnace under high vacuum. It is preferred for the lid body 7 to be composed of a light transmitting material (for example, silica glass etc.) having a coefficient of thermal expansion equal to that of the chamber body 6 so as to prevent a fracture resulting from a difference in the coefficients of thermal expansion thereof at the time of the vacuum sealing by fusing the low melting point glass layer 8.

The light transmission member 30 for exteriorly emitting the excitation light from the fluorescent material 16 is set up in an approximately central domain which opposes the anode electrode 15 (and fluorescent material 16). In the present embodiment the light transmission member 30 is, for example, composed of a plano-convex collimation lens with its lens curved face 30*a* protruding exteriorly; the frontal side focal point of the collimation lens is set to coincide with the focal point F of the surface 16*a* of the fluorescent material 16. The light transmission member 30 (collimation lens), by having the frontal side focal point thereof set at a position coinciding with the focal point F of the surface 16*a* of the fluorescent material 16, modulates the incident light from the fluorescent material 16 into nearly parallel light.

Further, an annular tapered face 31 is formed which flares from the front end side of the vacuum chamber 5 toward the base member side; on this tapered face 31 is mounted a pair of cathode electrodes 10 which face towards the fluorescent material 16. In the present embodiment, the electrode(s) 10 is composed of an electrically conductive pattern film-formed on the tapered face 31. This electrically conductive pattern is, for example, film-formed by depositing ITO, aluminum, nickel, and the like with a vapor deposition, sputtering method, or the like, or by applying a silver paste material followed by drying and firing, and the like.

Herein, as shown in FIG. 1, an electrically conductive part 32 extends exteriorly out of the cathode electrode 10, and an end of the electrically conductive part 32 is exposed outside of the vacuum chamber 5 through the low melting point glass layer 8, whereby the cathode electrode 10 is conductively connected to the outside of the chamber body 6.

The electron emission source 11 is film-formed on the upper layer of the cathode electrode 10. In the present embodiment, the electron emission source 11 is a cold cathode type electron emission source which emits electrons into a vacuum from a solid surface thereof upon application of an electric field, and is, for example, formed by applying as a film to a top layer of the cathode electrode 10 an emitter material, such as CNT (carbon nanotube), CNW (carbon nano wall), Spindt type micro cone, a metal oxide whisker, or the like.

In such a construction, when an electrical field is applied to the electron emission source 11, it emits electrons directed at the surface 16*a* of the fluorescent material 16. The surface 16*a* of the fluorescent material 16 emits light upon excitation by the field-emitted electrons, and the excitation light passes through the focal point F and is made incident onto the light transmission member 30. The light made incident onto the light transmission member 30 is collimated and radiated exteriorly.

In accordance with such an embodiment, even when the cathode electrode(s) 10 is offset mounted on a periphery of the light transmission member 30, it can be caused to precisely oppose the surface 16*a* of the fluorescent material 16 and further the excitation light from the entire face of the surface 16*a* of the fluorescent material 16 can be made incident onto the light transmission member 30 without interference from the cathode electrode(s) 10 or the like, by mounting the cathode electrode (s) 10 on a periphery of the transmission member 30, also mounting the anode electrode 15 on a domain opposite to the light transmission member 30, and forming, with a concave face, the surface 16*a* of the fluorescent material 16 to be mounted on the top layer of the anode electrode 15. Accordingly, the light emission efficiency of the light transmission member 30 can be improved, providing an exteriorly radiated high brightness light.

In this case, in particular, forming the surface 16*a* of the fluorescent material 16 in a concave curved face based on a paraboloid of revolution face enables the excitation light to be first condensed on the focal point F whereby nearly all the excitation light from the surface 16*a* of the fluorescent material 16 can be precisely made incident onto the light transmission member 30. Furthermore, if the light transmission member 30 is constituted of a collimation lens, the excitation light condensed at the focal point F can be suitably collimated and radiated.

Herein, as shown, for example, in FIG. 4, it is possible to form annularly the cathode electrode 10 and the electron emission source 11 over the entire periphery of the tapered face 31, and at the same time to form the anode electrode 15 and fluorescent material 16 over the entire periphery of the base member side of the interior face 6*a* of the chamber body 6. When constituted in this manner, the light-emitting apparatus 1 can be made to emit light at a higher light intensity.

Note that in the above-mentioned embodiment, an example was described in which the surface 16*a* of the fluorescent material 16 was formed in a concave face based on a paraboloid of revolution, but the present invention is not limited to this; the surface form of the fluorescent material can be suitably varied according to various uses. Namely, any concave form of the surface 16*a* of the fluorescent material 16 is acceptable as long as the electron emission source 11 which is offset on the periphery of the light transmission member 30 can directly be in opposition thereto, and can direct the excitation light to the light transmission member 30.

Moreover, in the above-mentioned embodiment, an example was described in which the form of the surface 16*a* of the fluorescent material 16 is made dependent on the form of the interior face 6*a* of the chamber body 6, but the present invention is not limited to this; for example, it is also possible to constitute the anode electrode using a concave-shaped electrically conductive plate or the like and to film-form a fluorescent material on the top layer of the anode electrode.

What is claimed is:

1. A light-emitting apparatus comprising, within a vacuum chamber, a cathode electrode having an electron emission source and an anode electrode having a fluorescent material which emits light upon excitation by the field-emitted electrons from said electron emission source, said apparatus exteriorly radiating the light emitted by said fluorescent material upon excitation from a light transmission ember mounted in said vacuum chamber; wherein said cathode electrode is mounted on a periphery of said light transmission member, and said anode electrode is mounted in a domain opposite to said light transmission member; and wherein the surface of said fluorescent material on a top layer of said anode electrode is formed with a concave face which directly faces said electron emission source to cause said field-emitted electrons to be directed to said surface without an additional electron reflective means for repelling said electrons toward said surface and away from said light transmission member, and said concave face further directs the excitation light to said light transmission member.

2. The light-emitting apparatus of claim 1, wherein said concave face is a curved face based on a paraboloid of revolution face.

3. The light-emitting apparatus of claim 2, wherein aid light transmission member is a collimation lens which modulates the excitation light emitted upon excitation at the surface of said fluorescent material and condensed at the focal point of paraboloid of revolution face into nearly parallel light.

* * * * *